US006425538B1

(12) United States Patent
Heren

(10) Patent No.: US 6,425,538 B1
(45) Date of Patent: Jul. 30, 2002

(54) NOZZLE WITH AUTOMATIC DISENGAGING BALE

(75) Inventor: Lawrence P. Heren, East Peoria, IL (US)

(73) Assignee: L. R. Nelson Corporation, Peoria, IL (US)

( * ) Notice: Subject to any disclaimer, the term of this patent is extended or adjusted under 35 U.S.C. 154(b) by 0 days.

(21) Appl. No.: 09/637,753

(22) Filed: Aug. 11, 2000

(51) Int. Cl.[7] ..... B05B 7/02
(52) U.S. Cl. ..... 239/526; 239/525; 239/289
(58) Field of Search ..... 239/289, 526, 239/525; 222/505, 509, 511, 518, 153.01, 153.14

(56) References Cited

U.S. PATENT DOCUMENTS 2,072,555 A * 3/1937 Hengesbach et al.
2,293,390 A * 8/1942 Hengesbach
2,657,098 A * 8/1953 Strahman
3,125,153 A * 3/1964 Lindgren
3,927,834 A * 12/1975 Tada ..... 239/359
4,449,696 A * 5/1984 Hengesbach ..... 251/231
4,523,700 A * 6/1985 Bower et al. ..... 222/505
D302,201 S * 7/1989 Hengesbach ..... D23/213
5,142,713 A * 9/1992 Makool ..... 4/525
5,975,429 A * 11/1999 Jezek ..... 239/124

* cited by examiner

*Primary Examiner*—Lesley D. Morris
*Assistant Examiner*—Christopher S. Kim
(74) *Attorney, Agent, or Firm*—Mayer, Brown, Rowe & Maw

(57) ABSTRACT

A nozzle having an actuating lever connected to the nozzle and a bale pivotally connected to the nozzle, wherein the bale is removably engageable with the actuating lever and contains angled portions. When the actuating lever comes into contact with the angled portions, the bale automatically disengages from the actuating lever.

6 Claims, 3 Drawing Sheets

NOZZLE WITH AUTOMATIC DISENGAGING BALE

FIELD OF INVENTION

This invention relates generally to nozzles. More specifically, this invention relates to lever actuated hose nozzles having bales.

BACKGROUND OF INVENTION

In order to direct a water stream coming from a garden hose in a pattern such as a jet stream or a conical-shaped stream, screw on nozzles have been devised and are well known in the art. Such screw on nozzles come in numerous configurations, such as barrel and pistol-grip configurations.

A typical pistol-grip nozzle includes a tubular body having a handle portion connectable at one end to the garden hose. The body of the nozzle has a fixed barrel portion extending from the opposite end of the hose connector at an angle similar to the angle between the handle and barrel of a gun. The water stream issues from the nozzle at the forward end of the barrel. The pattern and flow rate of the water stream is determined by a valve stem extending through the barrel portion and outwardly through the rear end thereof. Alternatively, the pattern and flow rate of the water stream can be controlled by a valve located intermediate the barrel and the handle portions. The movement of the valve in either case is controlled by a pivoted actuating lever which includes a portion generally parallel with the handle of the nozzle body enabling the user to grip the handle portion and actuating lever and to adjust the water stream issuing from the nozzle by a simple squeezing action between a user's fingers and palm. Such actuating lever can be located on either a front portion or a rear portion of the nozzle handle.

A barrel configuration, on the other hand, is usually in the form of a generally cylindrical body, which may be straight or arcuate in shape. One end of the body is adapted to be connected to the garden hose and the opposite end defines the nozzle from which the water stream issues. As with the pistol-grip nozzle, the barrel nozzle may have an actuating lever to control the flow of water through the nozzle Usually, a pivoting bale is provided on the nozzle handle for holding the actuating lever in a desired position, which is usually the position of the actuating lever in a fully opened position, with the maximum amount of water volume passing through the nozzle. The bale therefore minimizes user fatigue when operating the nozzle because the user will not have to keep pressure applied to the actuating lever in order to keep the fluid flowing through the nozzle.

Prior bale arrangements required a user to first engage the actuating lever to a desired operating position with one hand and then separately pivot the bale into position. Subsequently, to disengage the bale and release the actuating lever, the user would again have to engage the actuating lever with one hand so that there would be space between the bale and the lever, and then with the other hand move the bale so that the actuating lever could be released, hence stopping the flow of water. The two handed releasing procedure in particular has proven to be cumbersome. Thus, there is a need for a hose nozzle having a simple bale arrangement that can be easily released when a user desires to stop the flow of water through the nozzle or to modify the spray settings of the nozzle.

Other needs will become apparent upon a further reading of the following detailed description taken in conjunction with the drawings.

SUMMARY OF THE INVENTION

In one form, the present invention is embodied in a nozzle having an actuating lever connected to the nozzle and a bale pivotally connected to the nozzle, wherein the bale is removably engageable with the actuating lever and contains angled portions. When the actuating lever comes into contact with the angled portions, the bale automatically disengages from the actuating lever.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF THE PREFERRED EMBODIMENT

Figure 1:
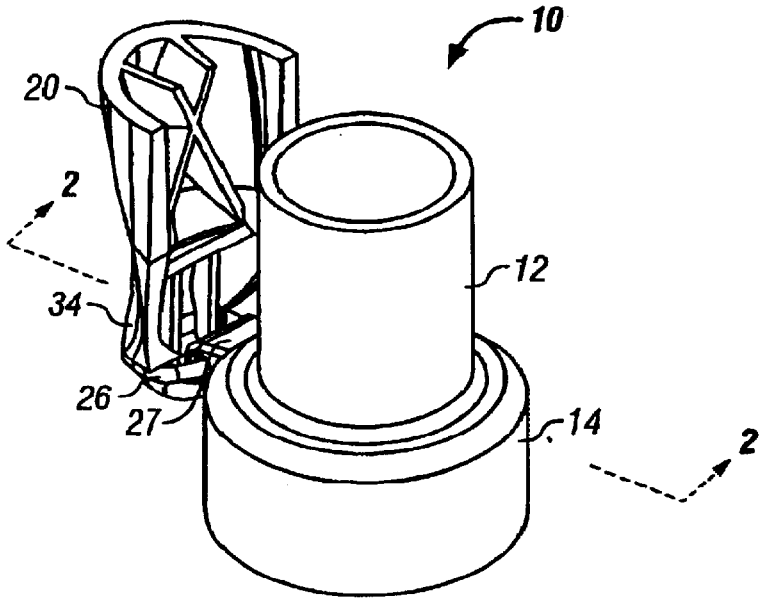
FIG. 1 is a partial perspective view of a hose nozzle with an actuating lever in an engaged position with a bale according to the present invention.

While the present invention is capable of embodiment in various forms, there is shown in the drawings and will be hereinafter described a presently preferred embodiment with the understanding that the present disclosure is to be considered as an exemplification of the invention, and is not intended to limit the invention to the specific embodiment illustrated.

Figure 2:
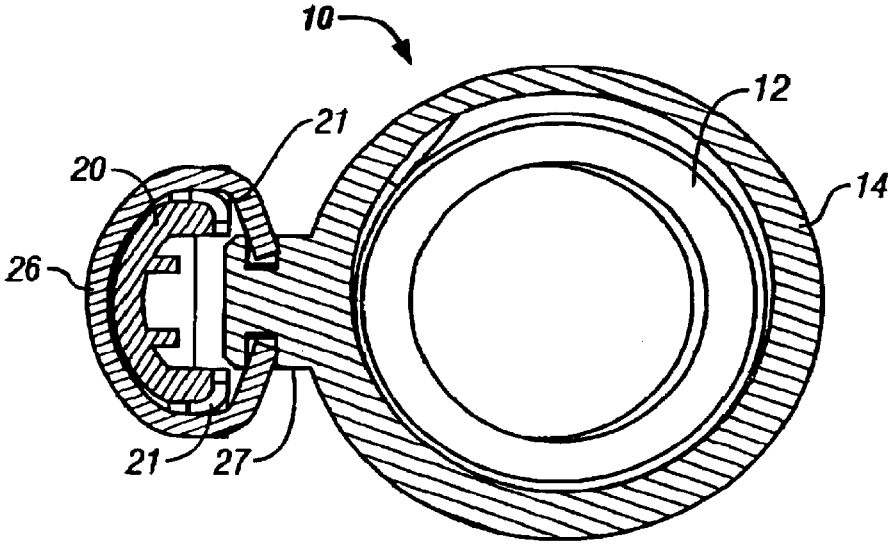
FIG. 2 is a cross-sectional view taken along line 2—2 of FIG. 1.
Figure 3:
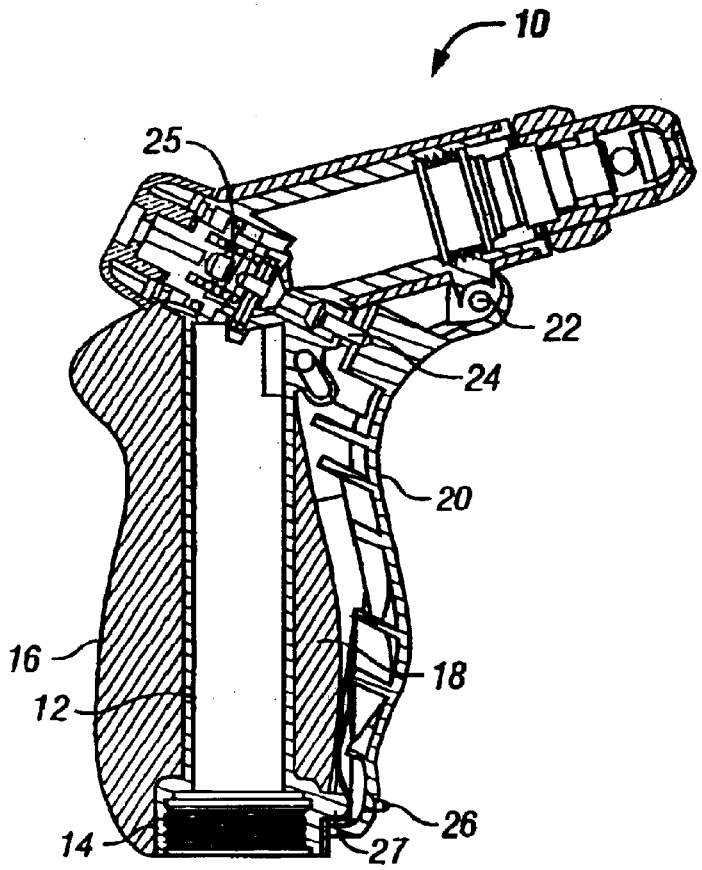
FIG. 3 is a full cross-sectional view of a hose nozzle with an actuating lever in an engaged position with a bale according to the present invention.

Referring now to the drawings and more particularly to FIGS. 1–3, there is shown a hose nozzle and portions thereof generally indicated as reference numeral 10. The hose nozzle includes a cylindrical body 12 having a lower end 14, which lower end contains internal female threads and is adapted for connection with a garden hose (not shown). In a fully assembled state, the hose nozzle 10 may include molded portions 16 and 18 (FIG. 3), which surround the cylindrical body 12 and provide an ergonomic grip for a user. However, one skilled in the art will realized that the nozzle of the present invention need not have such molded portions to operate.

The hose nozzle also includes an actuating lever 20, which pivots about an axis 22, and engages valve stem 24 to control the flow of fluid through the nozzle 10. The valve stem 24 is operatively connected to valve spring 25, which effectively biases the actuating lever 20 away from the valve spring 25 and the valve stem 24. The actuating lever 20 includes a rear portions 21. As is known in the art, pistol-grip nozzles can have either rear actuating levers (also called rear triggers) or front actuating levers (also called front triggers). The actuating lever in the embodiment illustrated in the drawings is in a front trigger configuration. However, although not shown in the drawings, one with skill in the art will recognize that the actuating lever can be located on the opposite side of the nozzle, and thus be in a rear trigger configuration. Moreover, the actuating lever could be used on a barrel-type nozzle, where the actuating lever could be located on the top, bottom, or sides of the barrel nozzle.

The hose nozzle 10 also includes a bale 26, which is preferably pivotally mounted to lower end 14 via bale mounting 27. As can be appreciated by viewing the drawings, bale 26 is used for locking the actuating lever 20 in a desired location. In the embodiment shown, the bale 26 is of a configuration such that the actuating lever 20 is kept in substantially a fully engaged position, thus allowing maximum fluid flow through the nozzle. However, it will be understood that a variety of bale sizes can be used to keep the actuating lever at various positions. For instance, the bale 26 could be larger in size so that the actuating lever will be kept at an intermediate position between an off position and a fully engaged position. Further, one skilled in the art will recognize that the bale 26 can be of a fixed size, or the bale 26 can be adjustable so as to accommodate various user preferences as to the preferred fluid flow rate through the nozzle 10, as controlled by the actuating lever 20.

Figure 4:
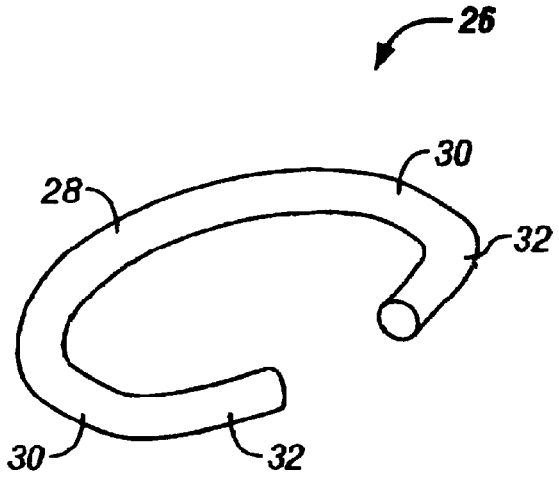
FIG. 4 is a perspective view of a bale according to the present invention.

As shown in FIG. 4, the bale 26 is in a generally hoop shape, and includes an arcuate portion 28, which is integral with and terminates in connector portions 30, which in turn are integral and terminate in angled portions 32. It will be appreciated that although the arcuate portion 28, connector portions 30 and angled portions 32 are shown as an integral bent structure, the bale 26 could be constructed utilizing a variety of construction techniques, including welding various constituent parts together. In a preferred embodiment of the invention, the angled portions 32 are at an approximately 20° angle below perpendicular to the connector portions 30. However, as one skilled in the art will appreciate, the angled portions 32 can comprise a multitude of angles or even curvilinear shapes, to accomplish the desired results of the present invention set forth herein. As will be described in more detail below, the angled portions 32 allow the bale 26 to be released from the actuating lever 20 without a user having to use two hands.

As those skilled in the art will readily understand, operation of the present invention is accomplished by a user first grabbing the pistol-grip hose nozzle 10 and squeezing the actuating lever 20 between his or her palm and fingers, against the bias of spring 25. When the actuating lever 20 is in a substantially fully engaged position, the user then rotates the bale 26 upwards so that it is substantially perpendicular with the actuating lever 20. Next, the user releases pressure on the actuating lever 20, thereby allowing the actuating lever to come into contact with the bale 26. At this point, the bale 26 will impeded the forward movement of the actuating lever 20, and the bale 26 will remain in its position due the friction between the actuating lever 20 and the bale 26.

Figure 5:
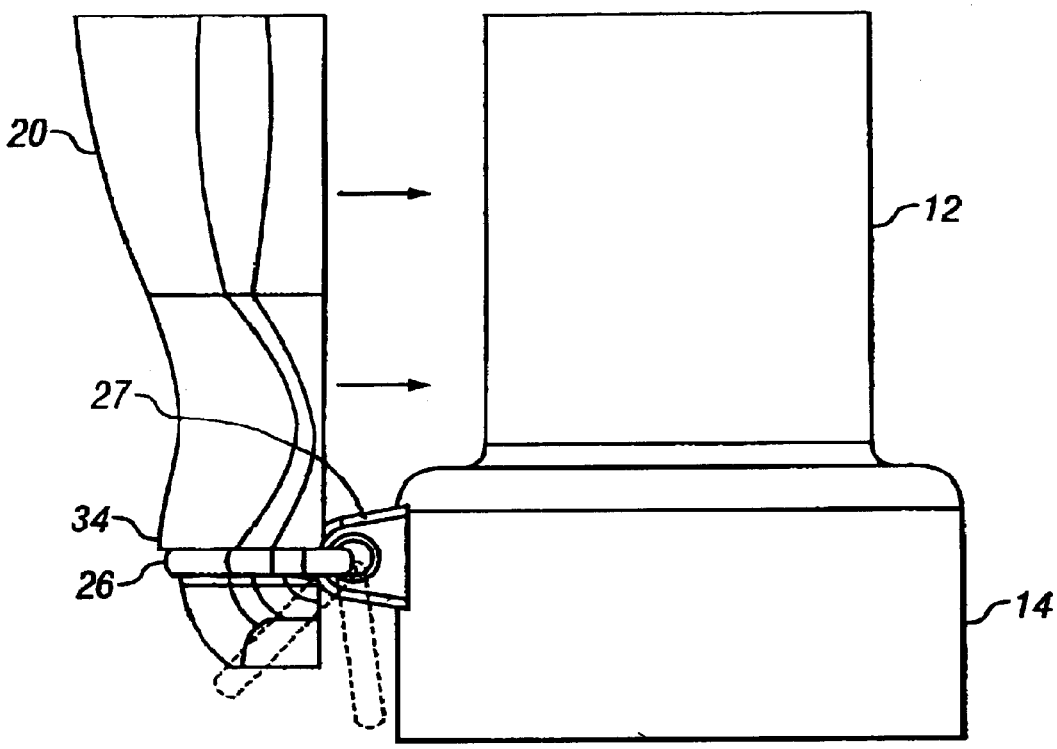
FIG. 5 is a side view of the hose nozzle of FIG. 1.

When the user wishes to disengage the bale 26 from the actuating lever 20, the user needs only to squeeze the actuating lever toward the pistol nozzle, as shown by the arrows in FIG. 5. When this is done, the rear portions 21 of the actuating lever come into contact with the bale 26, and more particularly, the angled portions 32 of the bale 26. Because the angled portions 32 gradually converge toward each other, the bale 26 when contacted by rear portions 21 will resist remaining in a position substantially perpendicular to the actuating lever 20. In essence, the actuating lever 20 acts as a cam and the angle portions 32 act as a cam follower. Accordingly, due to the shape of the angled portions 32 and due to the downward arching motion of the actuating lever 20, the bale 20 automatically rotates into a lowered position, as depicted in FIG. 5 in broken lines. Further, in order to prevent the bale 26 from moving upwards when contacted by actuating lever 20, the actuating lever 20 contains a ledge portion 34 that prevents upwards movement of the bale 26, thus ensuring that the bale 26 will move downwards when contacted by the actuating lever 20 and that the bale 26 will release the actuating lever 20. As one skilled in the art will understand, the bale arrangement of the present invention described herein can be used for a variety of nozzle configurations, including front trigger pistol-grip nozzles, rear trigger pistol-grip nozzles, and barrel nozzles.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A nozzle comprising:

an actuating lever connected to said nozzle, said actuating lever having a cam portion;

a bale pivotally connected to said nozzle, wherein said bale is removably engageable with said actuating lever, said bale containing a cam follower portion;

wherein when said cam portion comes into contact with said cam follower portion, said bale disengages with said actuating lever.

2. The nozzle of claim 1, wherein said nozzle is a pistol-grip nozzle.

3. The nozzle of claim 1, wherein said actuating lever is located proximate a front portion of said nozzle.

4. The nozzle of claim 1, wherein said actuating lever is located proximate a rear portion of said nozzle.

5. The nozzle of claim 1, wherein said actuating lever contains a ledge portion, wherein said ledge portion extends beyond an outer periphery portion of said bale.

6. The nozzle of claim 5, wherein said ledge portion is above said bale.

* * * * *